US008937816B2

(12) United States Patent
Trombino

(10) Patent No.: US 8,937,816 B2
(45) Date of Patent: Jan. 20, 2015

(54) CARRYING CASE WITH MULTI-FREQUENCY SHIELDING

(71) Applicant: Marc Trombino, Staten Island, NY (US)

(72) Inventor: Marc Trombino, Staten Island, NY (US)

( * ) Notice: Subject to any disclaimer, the term of this patent is extended or adjusted under 35 U.S.C. 154(b) by 175 days.

(21) Appl. No.: 13/749,662

(22) Filed: Jan. 24, 2013

(65) Prior Publication Data

US 2014/0203020 A1 Jul. 24, 2014

(51) Int. Cl.
*H05K 9/00* (2006.01)
*A45C 11/00* (2006.01)

(52) U.S. Cl.
CPC ..... *A45C 11/00* (2013.01)
USPC ..... 361/816; 220/502; 220/521; 220/523; 220/524; 361/800; 174/384; 174/520

(58) Field of Classification Search
USPC ..... 220/500, 502, 521, 523, 524; 361/818, 361/800, 523, 524; 206/150, 0.83, 0.84
See application file for complete search history.

(56) References Cited

U.S. PATENT DOCUMENTS

| | | | | |
|---|---|---|---|---|
| 5,402,095 | A | 3/1995 | Janniere | |
| 7,039,210 | B2 | 5/2006 | Holland | |
| 8,047,364 | B2 * | 11/2011 | Longinotti-Buitoni | 206/320 |
| 8,267,251 | B2 * | 9/2012 | Mongan et al. | 206/576 |
| 8,270,929 | B1 | 9/2012 | Koeppel | |
| 8,726,952 | B2 * | 5/2014 | Jambunathan et al. | 150/147 |
| 2003/0230514 | A1 * | 12/2003 | Baker | 206/732 |
| 2007/0262869 | A1 | 11/2007 | Young et al. | |
| 2010/0124040 | A1 * | 5/2010 | Diebel et al. | 361/816 |
| 2012/0044115 | A1 | 2/2012 | McCaughey | |
| 2012/0067751 | A1 * | 3/2012 | Mongan et al. | 206/216 |

FOREIGN PATENT DOCUMENTS

| | | | |
|---|---|---|---|
| EP | 2261767 | A1 | 12/2010 |
| RU | 2396890 | | 8/2010 |
| WO | 9829796 | | 7/1998 |
| WO | 2007074309 | A1 | 7/2007 |
| WO | 2007118962 | A1 | 10/2007 |

OTHER PUBLICATIONS

PCT International Search Report and Written Opinion, Jun. 10, 2014.

* cited by examiner

*Primary Examiner* — Robert J Hoffberg
*Assistant Examiner* — Hung Dang
(74) *Attorney, Agent, or Firm* — Gearhart Law LLC

(57) ABSTRACT

A carrying case having a first compartment and a second compartment for accommodating a plurality of objects; the first object which is embedded with integrated circuits that can process, store and communicate data on radio frequency identification microprocessors; said second object which is configured to process, store and communicate data on radio frequency identification microprocessors; said inner lining of said carrying case configured to include a radio frequency shielding; said shielding material including a layer of conductive material to attenuate interference fields and signals which are transmitted at varying frequencies and wavelengths; and wherein the shielding material is configured to block access to data which is stored on radio frequency identification microprocessors embedded in either the first object or second object.

9 Claims, 2 Drawing Sheets

CARRYING CASE WITH MULTI-FREQUENCY SHIELDING

BACKGROUND

1. Field of the Invention

The present invention relates to a carrying case which contains a multi-frequency shield for portable electronic devices and electronic smart cards.

2. Description of Related Art

Traditional carrying cases for portable electronic devices and smart cards are known in the art, such as the carrying case found in U.S. Publication No. 2012/0067751. Like U.S. Publication No. 2012/0067751, the carrying case itself does not purport to shield the device and card from varying frequencies nor do they claim to protect the sensitive data contained on the device and card. Such traditional cases provide accessibility to hackers who can access the sensitive information stored on your device or card. Other known art involves shielding mobile devices from radio frequencies by containing a Radio Frequency, or RF shield which is grounded to the actual mobile device's front or rear face as taught in U.S. Pat. No. 8,270,929. Such traditional shields do not solve the need of shielding electronic devices from being susceptible to varying degrees and types of frequencies other than Radio waves. Shields electronically connected to the back of the electronic devices do not provide protection from all directions. Any uncovered or unprotected part, albeit small, of a portable electronic device or electronic smart card will enable a savvy hacker the entryway into accessing sensitive information stored on the devices or cards. Portable electronic devices and allegoric smart cards must be shielded and unsusceptible to penetration from all directions, a feature found in the present invention. In U.S. Patent Application 2012/0044115, the specific absorption rate (SAR) of radio frequencies, in light of human health, is redistributed by an RF shield away from the user of a tablet or computer tablet by the carrying case. The redistribution magnetic strips found on the inside of this external case allow for gaps in the shielding of frequencies equal to and higher than radio waves. Rather than redistribution, the present invention's frequency shield eliminates the SAR of Radio Frequencies as well as other frequencies.

Conventional smart card portable cases, similar to the case found in U.S. Pat. No. 5,402,095 allow for the remote exchange of information between the smart card and the vendor receiving station by exposing the smart card through a clear window sleeve. Such cases do not solve the problem that the smart card is exposed and susceptible to hackers and criminals. Since the smart card is not fully enclosed, it leaves the radio frequency identification (RFID) tag unprotected which in turn leaves the security of information susceptible to those trying to penetrate, decrypt and obtain the sensitive and personal information stored on the smart card. It is the object of the present invention to provide a carrying case with a complete enclosure that solves this problem. Furthermore, conventional smart card cases have not contemplated the increased use of contactless smart cards. Contactless smart cards do not have to be exposed and/or accessed through a window sleeve and can be contained in a secure and impenetrable enclosure, such as the one found in the present invention.

SUMMARY OF THE INVENTION

A carrying case; including; a one piece rectangular exterior hard shell configured to open on a hinge; an interior top wall and interior bottom wall configured to provide protection against scratching; an inner lining configured on the interior top wall and interior bottom wall of the carrying case; the carrying case having a first compartment and a second compartment for accommodating a plurality of objects; said first compartment located below the interior top wall and abutted against the inner lining of the carrying case; said first compartment including a pocket to accommodate a generally rectangular first object; the first object which is embedded with integrated circuits that can process, store and communicate data on radio frequency identification microprocessors; the second compartment located above the interior bottom wall and abutted against the inner lining of the carrying case; said second compartment including a perimeter of plastic molding which can be adjusted to accommodate a second object; said second object which is configured to process, store and communicate data on radio frequency identification microprocessors; said inner lining of said carrying case configured to include a radio frequency shielding; said shielding material including a layer of conductive material to attenuate interference fields and signals which are transmitted at varying frequencies and wavelengths; and wherein the shielding material is configured to block access to data which is stored on radio frequency identification microprocessors embedded in either the first object or second object.

The carrying case includes a layer of conductive material including copper, aluminum or nickel. The layer of conductive materials is further adapted to include a layer soldered with no gaps, foil screen, foam, paint, and/or ink. The carrying case can accommodate a first object including contact less smart cards, chip cards, integrated circuit cards, cards which contains writeable memory cards containing non volatile memory storage components, or cards which contain microcontroller processing capabilities.

The carrying case can accommodate a second object including mobile phone devices, biometric passports, credit cards, or driver identification cards. The frequencies and wavelengths shielded include Wi-Fi; radiation; radio waves and signals; electromagnetic waves and signals, and magnetic waves and signals. The carrying case includes an exterior hard shell further comprising an access lid that is opened opposite the hinge located on the exterior horizontal edge of the carrying case. The carrying case includes an exterior hard shell further comprising an access lid that is opened opposite the hinge located on the exterior vertical edge of the carrying case. The carrying case includes an exterior hard shell comprised from plastic, metal and/or composite material.

The multi frequency shield of the carrying case is able to block various frequency strengths. A portable electronic device such as a mobile device must be able to receive radio frequencies but at the same time reflect radio energy but not such that you cannot receive radio signals. Depending on the country, operating band, and the technology on which a portable electronic device such as a mobile phone can operate on, the frequency can be as low as 698 MHz for $1^{st}$ generation and $2^{nd}$ generation wireless networks. Current $3^{rd}$ generation (3G) wireless network mobile devices can operate on a frequency of 1,710-1,755 and 2,110-2,155 MHz. Fourth Generation (4G) operating mobile devices can operate on a frequency of 2,496-2,690 MHz.

Radio signals exist as a form of electromagnetic waves. Radio signals are the same form of radiation as light, ultrasound, infra-red, gamma rays, x-rays etc, differing only in the wavelength or frequency of the radiation on the electromagnetic spectrum. Electromagnetic interference (EMI) can disrupt the operation of any electrical device. EMI can create malfunction and faulty readings in portable electronic devices. It can wreck havoc on control systems, data processing equipment and mobile phones. EMI disturbances interrupt, obstruct, degrade or limit the effective performance of the portable electronic device's circuits. This can lead to degradation of data to total loss of data on the portable electronic device. EMI can intentionally be used for electronic warfare (e.g. radio and mobile device jamming). Broadcast transmitter, two way radio transmissions, paging transmitters, cable TV are all sources of RF interference (RMI) and EMI. Other sources of RFI and EMI include doorbell transformers, toaster ovens, electronic blankets, ultrasonic pest control devices, electric bug zappers, heating pads and touch controlled lamps, all of which can effect a portable electronic device functionality. The need for a portable electronic device to contain a multi frequency shield is a growing issue and one readily solved by the frequency shielding found in the present inventions carrying case. Likewise, the need for creating a carrying case which can both provide security without impeding accessibility to sensitive and personal information stored on an electronic smart cards is increasingly important.

Today's, high tech and savvy computer hacker/criminal can not be afforded any gap or unshielded access to a persons portable electronic device and smart card. Today's fraudster could simply bump up against an unsuspecting victim with an RFID reader and scan a persons RFID signal through material like a leather wallet or cloth pants. Security concerns exist in regard to privacy over the unauthorized reading of RFID tags. The present invention allows a person to confidently and safely be able to carry their portable electronic device and electronic smart cards in a fully shielded carrying case.

Wallets or pockets are harsh environments for portable electronic devices and smart cards. Smart cards themselves are plastic, flexible and easily damaged. Portable electronic devices are expensive and their faces and front screen are prone to scratches and breakage. The need for a carrying case that can protect the aesthetic of the electronic device and the card is desired.

In general, in a first aspect, the invention features a carrying case which can open into two opposite compartments. Each compartment containing a one-piece frequency shield, each of which is sewn into the interior lining of the carrying two opposite compartments. Each frequency shield is made from conductive and/or magnetic materials. The materials used in creating the two one-piece frequency shields reduce the electromagnetic interference by Mocking the electromagnetic fields emitted from a variety of sources. The frequency shielding of the carrying case acts to isolate the portable electrical device and electronic smart cards from the outside world. The frequency shields of the carrying case block radio frequency electromagnetic radiation and act as an RF Shield.

The frequency shields of the present invention can be engineered to specificity. The frequency shields can be made from a variety of materials and in varying thicknesses. Such characteristics can be adapted and specially ordered by a manufacturers or consumers depending on the desired strength of the shield. The interior lining which houses the frequency shields can be of a soft fabric such as nylon or cotton. The inner lining of the carrying case holds the shielding in place and also acts as a scratch resistant layer to the face of the portable electric devices when the carrying case is in a closed position.

The carrying case has two opposing interior compartments. In the preferred embodiment, the first compartment houses the portable electronic device and the second compartment holds the electronic smart card. In other embodiments, the carrying case can be designed to hold a plurality of smart cards or a plurality of electronic devices. The compartment which holds the electronic smart card may contain a pouch made of fabric or plastic. The pouch contains an opening on the top for smart cards to be inserted into. In another embodiment, the pouch may contain a side opening for smart cards to be inserted into. In either embodiment, the opening of the pouch can be secured with a button, clasp or Velcro. The pouches hide the smart cards signature line, numbers and shield the RFID chips from hackers.

The carrying case's second interior compartment houses portable electronic device such as a mobile phone, smart phone, tablet or e-reader. The compartment will be fabricated from a moldable plastic or rubber which can stretch to accommodate a variety of portable electronic devices brands, styles, models and sizes. In another embodiment, the portable electronic device may be inserted into a pouch which can be secured with a button, clasp or Velcro. In another embodiment, the portable electronic device and be secured by a Velcro or nylon strap that spans across the top and bottom of the front face of the device. In the preferred embodiment of the invention and for maximum shielding protection, the portable electronic device may be left inside the carrying case such that the user is able to power on and off and use their portable electronic device.

The carrying case can open and close on a front hinge or on a side hinge. When closed the interior compartments are shielded from hackers and criminals. For contactless smart cards, the carrying case will be impenetrable when closed or open. When closed, the carrying case provides shielding from all directions and sides. In another embodiment of the invention, the hinge may contain a locking mechanism which would allow the carrying case to be opened and closed at varying degrees to provide extra assurances and shielding to users. When the carrying case is closed, the inner lining fabric will be one that will provide scratch resistant protection to the front face of the portable electronic device. Also, the exterior of the carrying case will be made from scratch resistant materials such as plastic, rubber or composite materials. The exterior of the carrying case may contain rounded edges or squared off edges depending on the users preferences. The exterior of the carrying case will be fabricated with a lock or clasp to allow for additional security.

In additional embodiments of the invention, the inner lining and exterior shell of the carrying can be made from aesthetically pleasing styles and designs. Such styles and designs allow for branding and marketing opportunities and do not affect the frequency shielding effectiveness.

The frequency shield of the carrying case is used to prevent access to data stored on Radio Frequency Identification (RFID) chips which are embedded in the portable electronic devices and in a variety of cards including biometric passports. An embodiment of the present invention may be enlarged to cover and shield a variety of objects, such as keyboards. The frequency shield can be adapted to be used to shield medical and laboratory equipment to provide protection against interfering signals including AM FM TV emergency services, dispatch, pagers, ESMR, cellular, and PCS. The frequency shield can be adapted to be used as the interior of shipping containers, courier packages and mailing envelopes.

The frequency shield of the carrying case may be constructed from copper, galvanized steel, aluminum, or conductible rubber, plastics or shielding paint. The frequency shield will be made from materials with high conductivity and thus can block high frequencies. The frequency shield of the carrying cases shield may be engineered so that the magnetic shield alloys become as broadband shields that protect against both EMI and RF interference.

The frequency shields can be made from a metal, such as copper, aluminum, silver and gold all of which are dielectric conductors and or insulators and allow for electromagnetic interference and waves to be reflected at the surface within the first few atoms of the material. The frequency shield of the carrying case absorbs little to no electromagnetic frequency. The embodiments of the present invention may have its shields fabricated from sheet metal, metal screen, or metal foam. The present embodiment may also include a shield that is coated with a metallic ink or spray painted with similar materials. The ink and paints consists of a carrier material loaded with a suitable metal, typically copper or nickel in the form of very small particulates. The metal aperture can be sprayed and once dry produces a continuous layer of metal which can then be sewn into the interior linings of the carrying case. The frequency shields can also be constructed from shielding fabrics of copper and/or nickel. Nickel is highly permeable alloy and would allow the nickel to absorb magnetic fields emitted from a variety of sources. Nickel can be fabricated as a foil or sheets. The nickel alloy frequency shield absorbs and redirects magnetic fluxes emitted by a variety of sources such as motors, power lines or transmitters and shields the magnetic field away from the portable electronic device and/or the smart card.

In a preferred embodiment, the frequency shield would be fabricated from copper, which would allow the reflection, refraction and/or diffraction of electromagnetic, radio and magnetic waves and would not allow the electromagnetic wave to pass through the shield and into the portable electronic device and card and thus not affect its functionality. Copper is malleable, thermal, electrically conducive, resistant to corrosion, high ductability antimicrobial, and recyclable. Copper can be in the form of a plate, sheet, strip, foil, or paint. Like the frequency shielding, the exterior and inner shell of the carrying case may be shielded as well with a paint such as Y Shield. In the preferred embodiment of the invention, the shield can be annealed. Annealed shields can improve a materials attenuation, the ability to absorb and redirect magnetic fields and waves.

In limited instances, the frequency shield may be of a mesh or grid form. Since radio signals have the lowest frequency and hence the longest wavelengths, any holes in the frequency shield must be significantly smaller than the wavelength of the radiation that is being kept out or the enclosure will effectively approximate an unbroken conducting surface. The higher the frequency the shorter the gaps in the grid have to be as the wavelengths are shorter. Regardless, the gaps must be soldered together for an effective frequency shield (i.e. solid electrical connectivity between the mesh elements at every junction).

The frequency shielding for the carrying case is configured and/or designed to possess 99% shielding effectiveness to shield frequencies from radio and TV signals with frequencies of 400-600 MHz, cellular phone with frequencies of 800-1900 MHz, Wi-Fi signals with frequencies at 2800 MHz, Wi-Max at frequencies of 4600 MHz and future technologies at frequencies of 5500 MHz and above.

In the preferred embodiment of the present invention, the carrying case will have two compartments each corresponding to its own uniquely engineered shield which will be enclosed into the inner lining. A single smart card can be programmed with multiple banking credentials, medical, driver license and public transport entitlements, loyalty programs and club memberships. Multi factor and proximity authentication can be embedded into a smart cards to increase the security to all services on the card. The need and desire for consumers to replace one card if their card is stolen and not multiple cards is great. Data storage on a smart card could contain medical information that is critical to an emergency and when coupled with an portable electronic device can allow the person assisting to conveniently and easily contact help. Citizen cards, driver licenses, hospital patient cards, biometric passports all rely on smart card integrated circuits. Smart Cards can serve as credit or ATM cards, fuel cards, prepayment cards, electronic wallets, digital, driver and age verification. Smart cards can hold or maintain account balances with or without a PIN, in an online or off line mode. Smart cards hold sensitive information both personal and financial and need to be protected against hackers and criminal.

Smart cards relationship to portable electronic devices such as mobile phone devices intersect at the use of a Subscriber Identity Module (SIM), or SIM card. The SIM card is a removable smart card ICC (Integrated Circuit Card). SIM cards are used to store service-subscriber key (IMSI), identify a subscriber and contain the portable electronic devices phone book. MicroSD cards are also a type of smart card which can be inserted into a mobile phone. MicroSD cards may contain RFID reader, such that a users portable electronic device can be linked to bank accounts and used in mobile payment. Such systems are used by Visa via payWave, MasterCard's PayPass, Discover's Zip, and American Express's Express Pay. Smart cards may also be used as telephone prepayment cards. Smart cards have been developed for public key infrastructure (PKI) based smart card management systems. As discussed above, smart cards hold sensitive information both personal and financial and need to be protected against hackers and criminal. However, the smart card needs to be able to be read and the information accessed by the proper parties.

The preferred embodiment of this invention will allow for the carrying of contactless smart cards as well. The carrying case will be adapted to hold a variety of contactless smart cards that allow for no physical contact between the card and the reader. Such smart cards exist for mass transit and motorway tolls such as Easy Pass. Smart cards are becoming singular in nature and are frequently programmed to only allow a contactless transaction if it is also within range of another device like a uniquely paired mobile phone. Similar to personal electronic devices, contactless smart cards are powered by RF induction technology and require only proximity to an antenna to communicate.

Both contactless and contact smart cards use Radio-frequency identification (RFID) technology, which is the use of a wireless non-contact system that uses radio-frequency electromagnetic fields to transfer data from a tag attached to an object, for the purposes of automatic identification and tracking. When the carrying case is partially or fully closed, the shields in the present invention will be able to protect low frequency, high frequency, and Ultra high frequency tags found in smart card from ranges as close a distance as a few millimeters. The carrying case will allow for cards to be authenticated and/or read from within the pouch while preventing unauthorized access by hackers or criminals when the carrying case is in a semi closed or fully closed position.

The pouch of the smart card compartment of the carrying case will be able to accommodate smart cards with measurements often found on a global level 3.37 in×2.125 inches or cards at 0.984 in×0.591 in cards (normal size of a SIM card). The pouch can hold a plurality of smart cards, each with a thickness of at least 0.030 inches. The pouch will ensure additional tamper resistant security systems while protecting in memory information. The carrying case will not interfere with a smart cards configuration settings, application data updates or interfere with card reading services such as ticket readers and ATM's.

The invention features a carrying case which is comprised of an exterior shell which can be opened on a hinge and closed with a clasp. The exterior shell can open into two opposite compartments. The first compartment can accommodate a plurality of portable electronic devices. The second compartment can accommodate a plurality of electronic smart cards in a pouch. Each compartment containing a one-piece frequency shield, each of which is sewn into the interior lining of the carrying case's two opposite compartments. The frequency shield and the exterior shell may made from materials that reduces the electromagnetic interference by Mocking the electromagnetic fields emitted from a variety of sources. The frequency shielding of the carrying case acts to isolate the portable electrical device and electronic smart cards sensitive information from hackers, criminals and interference.

DESCRIPTION OF THE DRAWINGS

Further objects and advantages of the invention will become apparent from the following description and from the accompanying drawings, wherein.

DETAILED DESCRIPTION OF THE DRAWINGS

Figure 1:
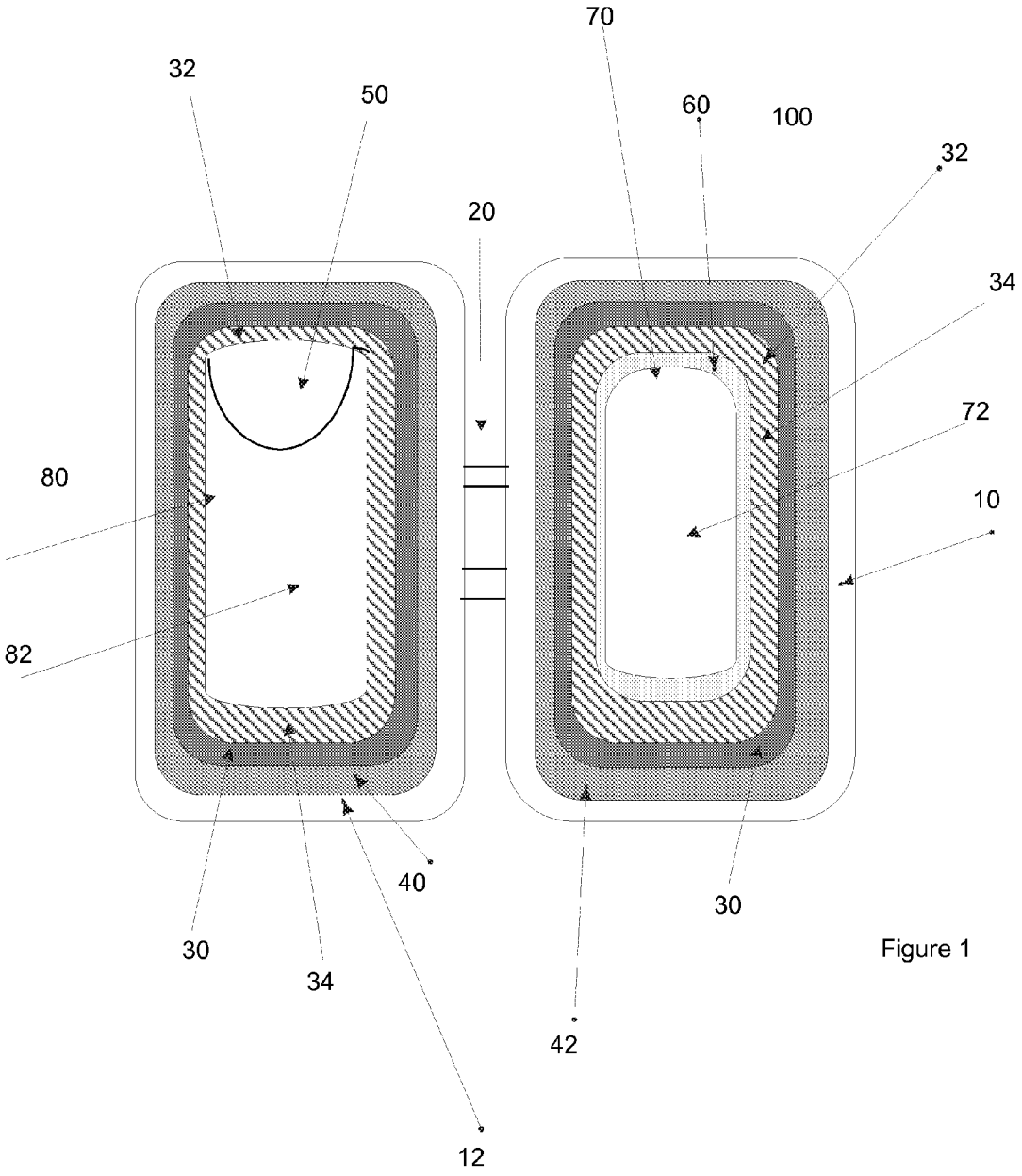
FIG. 1 is an illustrative embodiment of the carrying case in accordance with the present invention.

Referring now to the drawings in detail wherein like numerals indicate like elements throughout the several view, one sees from the various drawings, namely in FIG. 1 that the carrying case 100 includes a one piece rectangular exterior hard shell 10 configured to open on a hinge 20; an interior top wall 40 and interior bottom wall 42 configured to provide protection against scratching; an inner lining 30 configured on the interior top wall 40 and interior bottom wall 42 of the carrying case; the carrying case 100 having a first compartment 80 and a second compartment 70 for accommodating a plurality of objects; said first compartment 80 located below the interior top wall 40 and abutted against the inner lining 30 of the carrying case; said first compartment 80 including a pocket 50 to accommodate a generally rectangular first object 82; the first object 82 which is embedded with integrated circuits that can process, store and communicate data on radio frequency identification microprocessors; the second compartment 70 located above the interior bottom wall 42 and abutted against the inner lining 30 of the carrying case 100, said second compartment 70 including a perimeter of plastic molding 60 which can be adjusted to accommodate a second object 72; said second object 72 which is configured to process, store and communicate data on radio frequency identification microprocessors; said inner lining 30 of said carrying case 100 configured to include a radio frequency shielding 32; said shielding material 34 including a layer of conductive material to attenuate interference fields and signals which are transmitted at varying frequencies and wavelengths; and wherein the shielding material 34 is configured to block access to data which is stored on radio frequency identification microprocessors embedded in either the first object 82 or second object 72.

The shielding material 34 includes a layer of conductive material including copper, aluminum or nickel. The layer of conductive materials is further adapted to include a layer soldered with no gaps, foil screen, foam, paint, and/or ink. The carrying case too can accommodate a first object 82 including contact less smart cards, chip cards, integrated circuit cards, cards which contains writeable memory cards containing non volatile memory storage components, or cards which contain microcontroller processing capabilities.

The carrying case too can accommodate a second object 72 including mobile phone devices, biometric passports, credit cards, or driver identification cards. The frequencies and wavelengths shielded include Wi-Fi; radiation; radio waves and signals; electromagnetic waves and signals, and magnetic waves and signals. The carrying case too includes an exterior hard shell further comprising an access lid that is opened opposite the hinge located on the exterior horizontal edge of the carrying case. The carrying case includes an exterior hard shell to further comprising an access lid 12 that is opened opposite the hinge 20 located on the exterior vertical edge of the carrying case. The carrying case too includes an exterior hard shell to comprised from plastic, metal and/or composite material.

Figure 2:
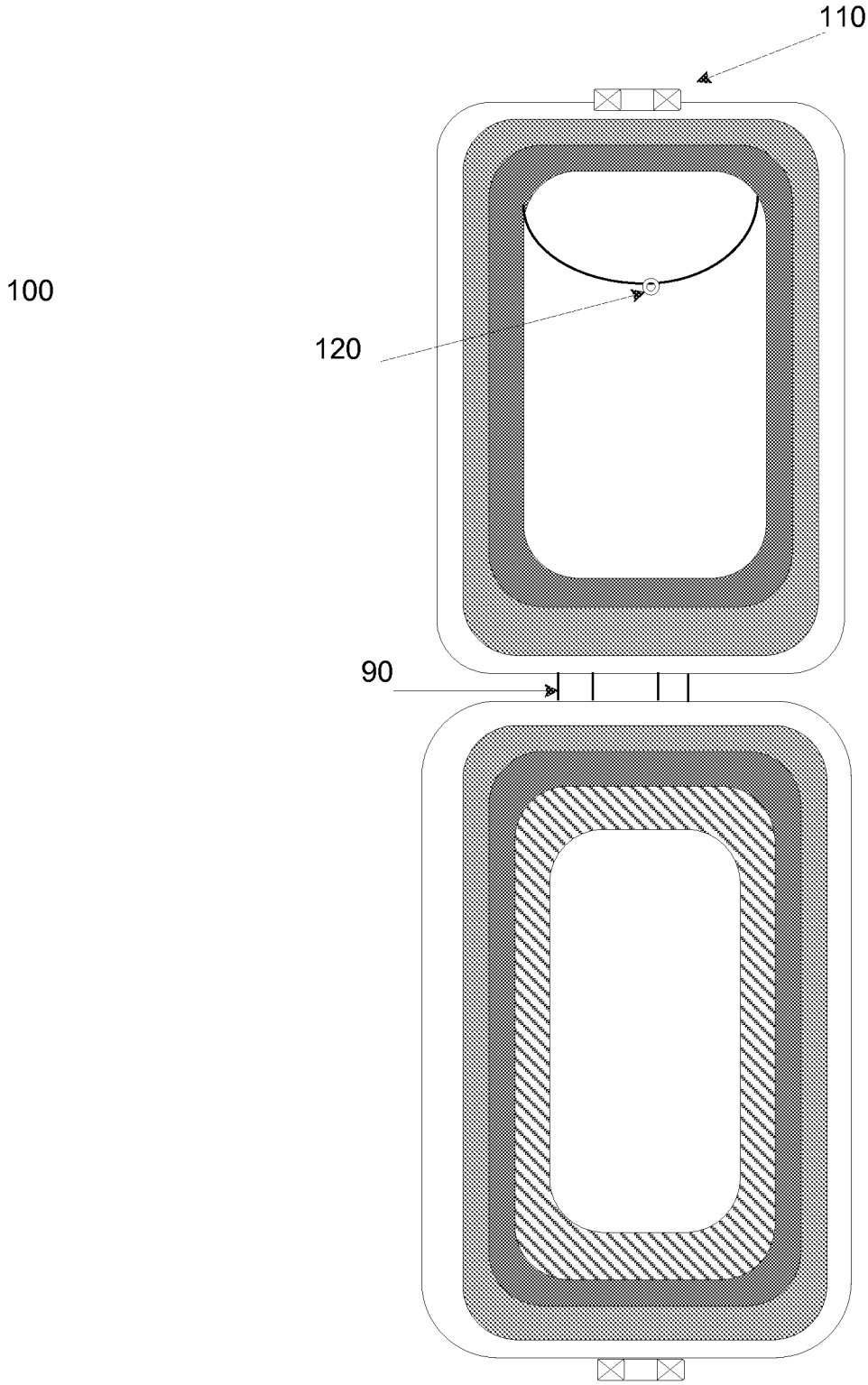
FIG. 2 is an illustrative embodiment of the carrying case in accordance with the present invention.

The carrying case too can be manufactured in two ways, one with a side hinge 20 as in FIG. 1 and with a back hinge 90 as in FIG. 2. One or more smart cards can be inserted or slid into the top slot of the pouch 50 from above or in another embodiment the smart card can be slid into the pouch's 50 side opening. The top slot of the pouch 50 can opened and closed with a button or Velcro.

A plastic, rubber or composite material molding 60 is able to fit a variety of portable electronic devices such as a mobile phone, smart phone or tablet.

In FIG. 2, the carrying case 100 has a locking mechanism no that secures the carrying case closed. Also shown in FIG. 2, is a clasp or button 120 which secures the pouch 50.

Additional features and advantages of embodiments of the invention will become apparent in the following description, from the drawings, and from the claims.

In order to address various issues and advance the art, the entirety of this application shows by way of illustration various embodiments in which the claimed invention may be utilized. The advantages and features of the application are of a representative sample of embodiments only, and are not exhaustive and/or exclusive. They are presented only to assist in understanding and teach the claimed principles. It should be understood that they are not representative of all disclosed embodiments. As such, certain aspects of the invention have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope and/or spirit of the invention. As such, all examples and/or embodiments are deemed to be non-limiting throughout this invention. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the invention. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the invention. As such, some of these features may be mutually contradictory, in that they cannot be simultaneously present in a single embodiment. Similarly, some features are applicable to one aspect of the invention, and inapplicable to others. In addition, the invention includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, logical, organizational, structural, topological, and/or other aspects of the invention are not to be considered limitations on the invention as defined by the claims or limitations on equivalents to the claims.

All statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It will be apparent to those skilled in the art that various modifications and variations can be made to the present invention without departing from the spirit or scope of the invention. Thus, it is intended that the present invention include modifications and variations that are within the scope of the subject invention and equivalents.

What is claimed is:

1. A carrying case; including:

a one piece rectangular exterior hard shell configured to open on a hinge;

an interior top wall and interior bottom wall configured to provide protection against scratching;

a inner lining configured on the interior top wall and interior bottom wall of the carrying case;

the carrying case having a first compartment and a second compartment for accommodating a plurality of objects;

said first compartment located below the interior top wall and abutted against the inner lining of the carrying case; said first compartment including a pocket to accommodate a generally rectangular first object; the first object which is embedded with integrated circuits that can process, store and communicate data on radio frequency identification microprocessors;

the second compartment located above the interior bottom wall and abutted against the inner lining of the carrying case; said second compartment including a perimeter of plastic molding which can be adjusted to accommodate a second object; said second object which is configured to process, store and communicate data on radio frequency identification microprocessors;

said inner lining of said carrying case configured to include a radio frequency shielding;

said shielding material including a layer of conductive material to attenuate interference fields and signals which are transmitted at varying frequencies and wavelengths; and wherein the shielding material is configured to block access to data which is stored on radio frequency identification microprocessors embedded in either the first object or second object.

2. The carrying case of claim 1, wherein the layer of conductive material includes copper, aluminum or nickel.

3. The carrying case of claim 2, wherein the layer of conductive materials is further adapted to include a layer soldered with no gaps, foil screen, foam, paint, and/or ink.

4. The carrying case of claim 1, wherein the first object includes contactless smart cards, chip cards, integrated circuit cards, cards which contain writeable memory cards containing non volatile memory storage components, or cards which contain microcontroller processing capabilities.

5. The carrying case of claim 1, wherein the second object includes mobile phone devices, biometric passports, credit cards, or driver identification cards.

6. The carrying case of claim 1, wherein the frequencies and wavelengths include Wi-Fi; radiation; radio waves and signals; electromagnetic waves and signals, and magnetic waves and signals.

7. The carrying case of claim 1, wherein the exterior hard shell further comprising an access lid that is opened opposite the hinge located on the exterior horizontal edge of the carrying case.

8. The carrying case of claim 1, wherein the exterior hard shell further comprising an access lid that is opened opposite the hinge located on the exterior vertical edge of the carrying case.

9. The carrying case of claim 1, wherein the exterior hard shell is comprised from plastic, metal and/or composite material.

* * * * *